US007856856B2

(12) United States Patent
Shvartz

(10) Patent No.: US 7,856,856 B2
(45) Date of Patent: Dec. 28, 2010

(54) INDEPENDENTLY INTERACTIVE INTERCONNECTED LOCK

(75) Inventor: Vladimir Shvartz, Woodmere, NY (US)

(73) Assignee: Assa Abloy, Inc., New Haven, CT (US)

( * ) Notice: Subject to any disclaimer, the term of this patent is extended or adjusted under 35 U.S.C. 154(b) by 0 days.

(21) Appl. No.: 12/034,144

(22) Filed: Feb. 20, 2008

(65) Prior Publication Data

US 2008/0141740 A1 Jun. 19, 2008

Related U.S. Application Data

(62) Division of application No. 11/069,402, filed on Feb. 28, 2005, now Pat. No. 7,363,784.

(51) Int. Cl.
*E05B 59/00* (2006.01)
*E05B 63/14* (2006.01)

(52) U.S. Cl. ..... 70/107; 70/129; 70/190; 292/142; 292/172; 292/279

(58) Field of Classification Search ..... 70/16, 70/107, 129, 134, 141, 144, 190; 292/38, 292/42, 51, 112, 142, 160, 172, 199, 279, 292/280, 336.3
See application file for complete search history.

(56) References Cited

U.S. PATENT DOCUMENTS

| | | | | |
|---|---|---|---|---|
| 1,528,515 | A | 3/1925 | Taylor | |
| 3,791,180 | A * | 2/1974 | Doyle | 70/107 |
| 3,881,331 | A | 5/1975 | Tranberg et al. | |
| 3,933,016 | A | 1/1976 | Nolin | |
| 3,990,277 | A | 11/1976 | Mullich | |
| 4,606,203 | A | 8/1986 | Esser | |
| 4,709,565 | A | 12/1987 | Lin | |
| 4,809,526 | A | 3/1989 | Shen | |
| 4,962,653 | A | 10/1990 | Kaup | |
| 5,083,448 | A | 1/1992 | Kärkkäinen et al. | |
| 5,388,875 | A | 2/1995 | Fleming | |

(Continued)

FOREIGN PATENT DOCUMENTS

| | | | |
|---|---|---|---|
| DE | 3731879 | A1 | 4/1989 |

(Continued)

OTHER PUBLICATIONS http://dictionary.reference.com/browse/lost+motion.*

*Primary Examiner*—Suzanne Dino Barrett
*Assistant Examiner*—Alyson M Merlino
(74) *Attorney, Agent, or Firm*—DeLio & Peterson, LLC

(57) ABSTRACT

An independently interactive interconnected lock includes an interconnecting mechanism that retracts a latchbolt and a deadbolt when an inner handle is moved between an up position, an intermediate position and a down position. The deadbolt is retracted by a deadbolt lock mechanism as the inner handle moves from the up position to the intermediate position. The latchbolt is retracted by a latchbolt lock mechanism as the inner handle continues to move from the intermediate position to the down position. When the inner handle is moved to the up position, both the latchbolt and deadbolt are extended and the deadbolt lock mechanism is disconnected from the latchbolt lock mechanism such that manipulation of the latchbolt lock mechanism to retract the latchbolt does not retract the deadbolt. The inner handle operates with low handle torque because the deadbolt and the latchbolt are not retracted simultaneously.

17 Claims, 3 Drawing Sheets

U.S. PATENT DOCUMENTS

| | | | | |
|---|---|---|---|---|
| 5,495,731 | A | 3/1996 | Riznik | |
| 5,707,090 | A * | 1/1998 | Sedley | 292/172 |
| 6,266,981 | B1 | 7/2001 | von Resch et al. | |
| 6,324,876 | B1 | 12/2001 | Prevot et al. | |
| 6,536,245 | B2 | 3/2003 | Chiang | |
| 6,564,596 | B2 | 5/2003 | Huang | |
| 6,581,423 | B2 | 6/2003 | Lin | |
| 6,651,466 | B1 | 11/2003 | Shih | |
| 6,684,669 | B1 | 2/2004 | Talpe | |
| 6,725,693 | B2 | 4/2004 | Yu et al. | |
| 6,733,050 | B1 | 5/2004 | Yao | |
| 7,363,784 | B2 * | 4/2008 | Shvarts | 70/107 |
| 2002/0095958 | A1 | 7/2002 | Bates et al. | |
| 2004/0107746 | A1 | 6/2004 | Chang | |
| 2004/0107747 | A1 | 6/2004 | Chang | |
| 2005/0092040 | A1 * | 5/2005 | Chuang | 70/107 |

FOREIGN PATENT DOCUMENTS

| | | | |
|---|---|---|---|
| DE | 3826802 | A1 | 2/1990 |
| DE | 3836693 | A1 | 5/1990 |
| DE | 3836694 | A1 | 5/1990 |

* cited by examiner

INDEPENDENTLY INTERACTIVE INTERCONNECTED LOCK

BACKGROUND OF THE INVENTION

1. Field of the Invention

This invention relates to interconnected locks. Interconnected locks are locks in which the outside of the door appears to have two separate conventional locks comprising a latchbolt lock mechanism on the bottom and a deadbolt lock mechanism on the top. On the inside of the door, however, the latchbolt and deadbolt are interconnected so that rotating the inner handle automatically retracts the deadbolt as the latchbolt is retracted.

2. Description of Related Art

From the locked outer side, a door fitted with an interconnected lock appears to have two separate conventional locks. Typically the upper lock appears to be a conventional deadbolt operated by a key to drive a deadbolt and the lower lock appears to be a standard cylindrical or tubular lock that drives a latchbolt. On the inside however, the two locks are interconnected.

A principal advantage of interconnected locks is that they simplify exiting a locked area. With separately installed deadbolt and latchbolt locks, exiting a locked area requires two motions—rotating a thumb turnpiece to retract the deadbolt and rotating the inner handle to retract the latchbolt. To exit through an interconnected lock requires only a single motion. Rotating the inner handle of the interconnected lock simultaneously retracts the deadbolt and the latchbolt.

The convenience provided by the interconnection described above, however, is a security disadvantage for conventional prior art interconnected locks. If a vandal is able to break off or remove the outer handle it may be possible to gain access from outside the locked area through the failed latchbolt lock to the inside spindle or other latchbolt lock components turned by the inner handle. In such a case, the interconnection of a prior art interconnected lock between the latchbolt lock components and the deadbolt lock will allow the vandal to retract the deadbolt as well as the latchbolt by manipulating the components of the interconnected lock on the inner side of the door. When the deadbolt and latchbolt are separately installed, failure of the latchbolt lock mechanism does not affect the security of the deadbolt lock mechanism.

Because latchbolt locks, such as cylindrical locks and tubular locks, are generally less resistant to attack than deadbolt locks, the overall security of prior art interconnected locks is less than for an installation using a completely separate and independent deadbolt and latchbolt lock. There is a need for an interconnected lock design where the deadbolt and latchbolt lock mechanisms interact to provide the advantages of an interconnected lock, yet which is as secure as separately installed and independently operated deadbolt and latchbolt lock mechanisms.

Because of the ease with which a locked area may be exited, interconnected locks are often installed for use by the elderly or infirm. The speed of operation and simplicity of use of the interconnected lock is particularly valuable in an emergency, such as a fire. The benefits may be greatest when the occupant of the locked room is elderly and/or has reduced mental capabilities, as they may not remember to rotate the thumb turnpiece of a separately installed deadbolt before attempting to exit via the locked door.

However, these advantages for the elderly and mentally disabled are offset by the current design of interconnected locks for those who are physically disabled, weak, injured or infirm. Conventional interconnected locks simultaneously retract the latchbolt and the deadbolt as the inner handle is turned. The simultaneous operation of the latchbolt and deadbolt mechanisms requires more torque than operating these elements separately. The elderly and infirm may not be able to easily produce the increased torque required, making the interconnected lock more difficult to operate by those for whom the lock offers some of the greatest advantages.

The use of lever handles to provide more handle torque, as used in public buildings to improve access by the disabled, exacerbates the security disadvantage described above because a vandal can use a lever handle to produce more torque and break the latchbolt lock portion of an interconnected lock. Accordingly, there is a need for an interconnected lock that does not require more torque to operate than the torque required to separately operate a conventional deadbolt or a conventional cylindrical lock.

Another disadvantage of conventional interconnected locks is that they simplify the process of exiting a locked area, but not the process of locking the door. The deadbolt portion of the interconnected lock must still be separately locked by rotating the thumb turnpiece on the inside of the door after the door is closed. Often, this is not done. It would be desirable for an improved interconnected lock design to allow the deadbolt to be extended as easily as it is retracted.

SUMMARY OF THE INVENTION

Bearing in mind the problems and deficiencies of the prior art, it is therefore an object of the present invention to provide an interconnected lock that is more secure than conventional interconnected locks, particularly when lever handles are installed.

It is another object of the present invention to provide an interconnected lock that requires less handle torque to operate the lock than is required to operate conventional interconnected locks that simultaneously retract the latchbolt and the deadbolt.

A further object of the invention is to provide an interconnected lock that simplifies the process of locking by extending the deadbolt with the inner handle, as well as retracting it.

It is yet another object of the present invention to provide an interconnected lock that allows the state of the lock to be quickly determined from the position of the inner handle.

Still other objects and advantages of the invention will in part be obvious and will in part be apparent from the specification.

The above and other objects, which will be apparent to those skilled in the art are achieved in the present invention which is directed to an independently interactive interconnected lock having a latchbolt lock mechanism, a deadbolt lock mechanism and an interconnecting mechanism connected between the latchbolt and the deadbolt lock mechanisms.

The latchbolt lock mechanism is mountable in a first bore through a door, and the deadbolt lock mechanism is mountable in a second bore through the door offset from the first bore. The latchbolt lock mechanism includes a latchbolt and an outer handle that moves the latchbolt between latched and unlatched positions.

The deadbolt lock mechanism is mountable in a second bore through the door offset from the first bore. The deadbolt lock mechanism includes a deadbolt movable between bolted and unbolted positions.

The interconnecting mechanism is operable by an inner handle to drive the latchbolt between the latched and unlatched positions and the deadbolt between the bolted and unbolted positions. The inner handle is movable between an up position, an intermediate position and a down position. The interconnecting mechanism drives the deadbolt to the bolted position when the inner handle is moved to the up position. It drives the deadbolt to the unbolted position when the inner handle is moved to the intermediate position, and it drives the latchbolt to the unlatched position when the inner handle is moved to the down position.

In the preferred design of the independently interactive interconnected lock, the inner handle drives the deadbolt from the bolted position to the unbolted position as the inner handle moves from the up position to the intermediate position and the inner handle drives the latchbolt from the latched position to the unlatched position as the inner handle moves from the intermediate position to the down position.

An aspect of the invention is that the interconnecting mechanism disconnects the latchbolt lock mechanism from the deadbolt lock mechanism when the inner handle is moved to the up position. Thus, manipulation of the latchbolt lock mechanism from the outside to move the latchbolt to the unlatched position does not move the deadbolt to the unbolted position.

Another aspect of the invention is that the inner handle and outside handle rotate on different axes of rotation. The axis of rotation of the outer handle is through the first bore and the axis of rotation of the inner handle is located between the first and second bores, which correspond to the positions of the latchbolt and deadbolt mechanisms.

In the most highly preferred embodiment of the invention, the interconnecting mechanism includes two deadbolt drivers, which may be deadbolt gears. The two deadbolt drivers are offset from the axis of rotation of the outside handle by distances that correspond to two industry standard bore offset distances for installing separate latchbolt locks and deadbolt locks. This allows the lock to be used with existing installations, pre-bored doors and templates and tools for boring doors at either of the industry standard offset distances.

In the preferred design of the invention the inner handle drives a handle gear that is a partial gear. The handle gear engages and drives at least one deadbolt gear as the inner handle moves from the up position to the intermediate position to drive the deadbolt from the bolted to the unbolted position. The handle gear does not drive the deadbolt gear as the inner handle moves from the intermediate position to the down position. A reengagement spring acts to apply a force to reengage the deadbolt gear and the partial handle gear as the inner handle moves through the intermediate position when moving from the down position to the up position.

The deadbolt gear drives two secondary deadbolt gears preferably via an intermediate deadbolt gear. The two secondary deadbolt gears form two alternative deadbolt drivers offset from an axis of rotation of the outside handle by distances that correspond to two industry standard bore offset distances.

In order to drive the latchbolt lock mechanism independently of the deadbolt lock mechanism, the inner handle drives a first latchbolt lever with lost motion from a latchbolt extended position to a latchbolt retracted position. The inner handle does not drive the first latchbolt lever as the inner handle moves from the up position to the intermediate position during the lost motion interval. The inner handle begins to drive the first latchbolt lever to retract the latchbolt as the inner handle moves from the intermediate position to the down position.

The latchbolt lever drives a latchbolt slide vertically. The latchbolt slide, in turn, drives a second latchbolt lever connected to a latchbolt hub, which is connected to drive the latchbolt lock mechanism and retract the latchbolt. To reduce friction between the first latchbolt lever and the latchbolt slide, the latchbolt slide includes a roller at the point of contact between the first latchbolt lever and the latchbolt slide.

The latchbolt slide preferably engages the second latchbolt lever with a rotating bearing having a slide channel formed therein. The rotating bearing rotates in the latchbolt slide and the second latchbolt lever slides in the slide channel of the rotating bearing.

In an alternative embodiment of the invention, the handle gear interferes with the latchbolt hub when the inner handle is in the up position to prevent the outside handle from turning when the inner handle is in the up position and the deadbolt is extended.

The invention is also directed to a bored lock interconnecting mechanism for driving a latchbolt lock mechanism in a first bore of a door and a deadbolt lock mechanism in a second bore of the door. The interconnecting mechanism includes a handle gear rotated by an inner handle movable between an up position, an intermediate position and a down position. At least one deadbolt gear is connected to drive the deadbolt lock mechanism between bolted and unbolted positions.

The deadbolt gear is driven by the handle gear as the inner handle moves between the up position and the intermediate position and is not driven by the handle gear as the inner handle moves between the intermediate position and the down position.

A latchbolt hub is connected to drive the latchbolt lock mechanism between latched and unlatched positions. The latchbolt hub is driven by the handle gear with lost motion such that the latchbolt hub is not driven by the handle gear as the inner handle moves between the up position and the intermediate position and the latchbolt hub is driven by the handle gear as the inner handle moves between the intermediate position to the down position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 5 illustrates the interconnecting mechanism in the latched and bolted position that corresponds to FIG. 2 where the inner handle is in the up position.

FIG. 6 illustrates the interconnecting mechanism in the latched and unbolted position that corresponds to FIG. 3 where the inner handle is in the intermediate position.

FIG. 7 illustrates the interconnecting mechanism in the unlatched and unbolted position that corresponds to FIG. 4 where the inner handle is in the down position and the door can be opened.

FIG. 8 illustrates the interconnecting mechanism in the latched and bolted position that corresponds to FIGS. 2 and 5 where the inner handle is in the up position with the deadbolt and latchbolt extended.

DESCRIPTION OF THE PREFERRED EMBODIMENT(S)

Figure 4:
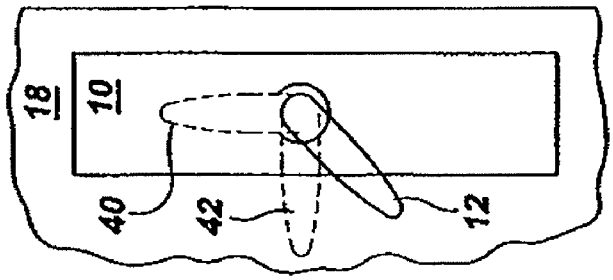
FIG. 4 shows the same view as in FIGS. 2 and 3 except that the lock is shown with the inner handle in the down position where both the latchbolt and the deadbolt are retracted so that the door may be opened.

In describing the preferred embodiment of the present invention, reference will be made herein to FIGS. 1-8 of the drawings in which like numbers refer to like features of the invention.

Referring to FIGS. 1-4, the present invention includes an interconnecting mechanism 10 having an inner handle 12 that drives a latchbolt lock mechanism 14 and a deadbolt lock mechanism 16. The interconnecting mechanism 10 is installed on the inside 18 of door 20.

The latchbolt lock mechanism 14 includes an outer handle 22 and an outer portion 24 mounted on the outer surface 26 of door 20. The latchbolt lock mechanism 14 is a substantially conventional bored lock, such as a cylindrical lock or tubular lock, that includes a conventional lock core (not shown) installed in a first bore 28 (see FIG. 2) that extends perpendicularly from the inner surface 18 of door 20 to the outer surface 26. The axis of the bore 28 is aligned with the axis of rotation of the outer handle 22. The latchbolt lock mechanism 14 operates a conventionally installed latchbolt 30.

The deadbolt lock mechanism 16 includes a key operated outer portion 32 that is conventionally installed in a second bore 34 (see FIG. 2) and a deadbolt 36.

Figure 1:
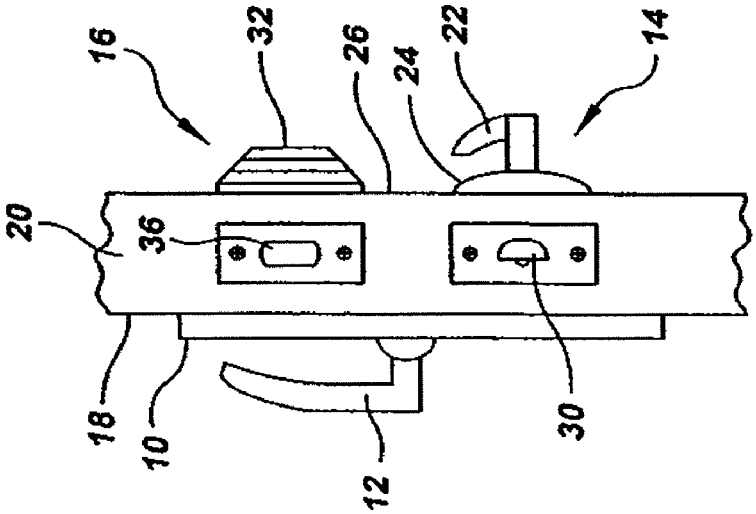
FIG. 1 is a right side elevational view of an interconnected lock according to the present invention showing the lock installed in a portion of a door. The view is from the edge of the door and shows that the inner handle on the left rotates on a different axis from the outer handle on the right. The inner handle is shown in the up position, indicating that the interconnected lock is latched and bolted.
Figure 1A:
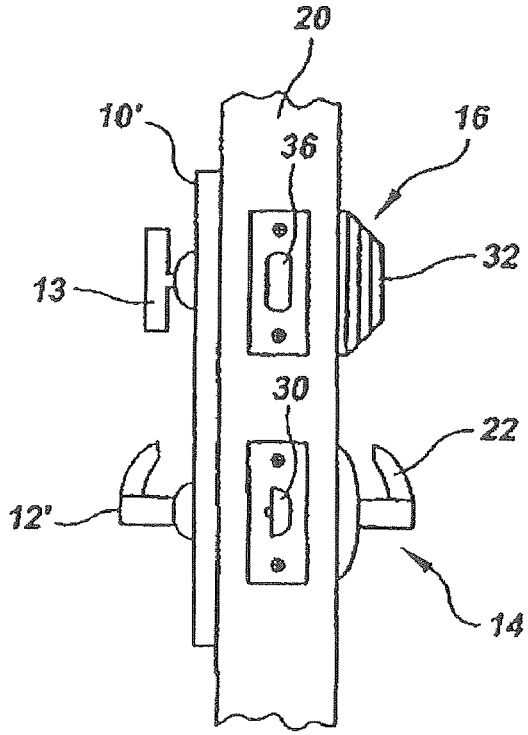
FIG.1a PRIOR ART
FIG. 1*a* is a right side elevational view of an interconnected lock according to the prior art showing the lock installed in a portion of a door. The view is from the edge of the door and shows that the inner handle on the left rotates on the same axis as the outer handle on the right. The thumb turnpiece required for a prior art interconnected lock is also shown.

FIG. 1*a* shows a prior art installation of an interconnecting mechanism 10' operating a deadbolt lock mechanism 16 and a latchbolt lock mechanism 14. It can be seen that the interconnected lock of this invention and an interconnected lock of the prior art appear from the outside to be a conventional separately installed deadbolt 16 and latchbolt 14. The outer portions of the deadbolt and latchbolt lock mechanisms, as well as the latchbolt and deadbolt themselves are the same in FIGS. 1 and 1*a* and are conventional in design as used in separate installations as well as in interconnected lock designs.

However, on the inside of the door, the present invention, as seen in FIG. 1, provides an interconnecting mechanism 10 and associated inner handle 12 that differ significantly from the interconnecting mechanism 10' and inner handle 12' of the prior art design seen in FIG. 1*a*. Specifically, the present invention omits the inner thumb turnpiece 13 of FIG. 1*a* and moves the inner handle 12 to a different rotational axis from the outer handle 22 and inner handle 12' of the prior art.

In interconnected locks of the prior art, as exemplified in FIG. 1*a*, the inner handle 12' and the outer handle 22 rotate on the same axis. However, as can be seen in FIG. 1, in the present invention, the inner handle 12 rotates on a separate axis from the outer handle. The inner handle 12 of the present invention rotates on an axis that is located between the axes of the first and second bores 28, 34.

As will be described in detail below, by placing the inner handle on a different axis from the rest of the latchbolt lock mechanism 14 and outer handle 22, it is possible to operate the latchbolt lock mechanism and deadbolt lock mechanisms independently, yet allow them to interact as necessary. This independent operation improves security by decoupling the inner handle 12 and the deadbolt lock mechanism 16 from the outer handle 22 and the latchbolt lock mechanism 14. The deadbolt is isolated from the inside components of the latchbolt lock mechanism and the hub 80 (see FIGS. 5-7) used to turn the inside spindle of the latchbolt lock mechanism.

Even if the outer handle 22 is broken off or removed, and even if the inside components of the latchbolt lock mechanism are manipulated from the outside to retract the latchbolt, the decoupling design of the present invention prevents the deadbolt from being simultaneously retracted with the latchbolt.

Figure 3:
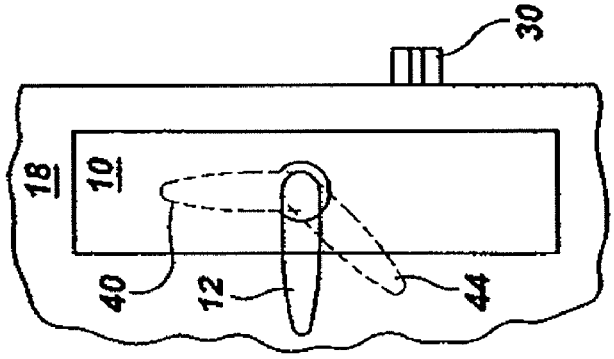
FIG. 3 is also a front elevational view of the interconnected lock as in FIG. 2 except that the lock is shown with the inner handle in the intermediate position where the latchbolt is extended and the deadbolt is retracted.
Figure 2:
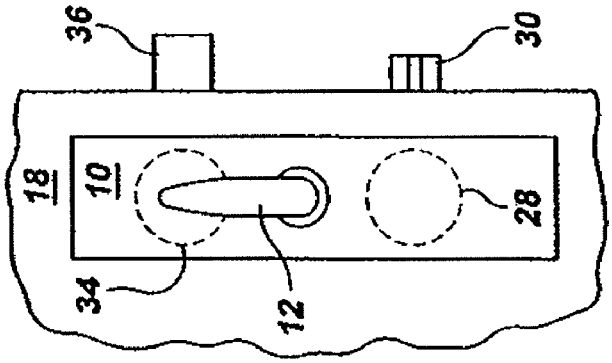
FIG. 2 is a front elevational view of the interconnected lock in FIG. 1 showing the interconnected lock from the inside of the door. The inner handle is in the up position as in FIG. 1 and it can be seen that the deadbolt and latchbolt are both extended, indicating that the interconnected lock is latched and bolted.

FIGS. 2-4 show the interconnected lock of the present invention in three different states corresponding to 1) bolted and latched, 2) unbolted and latched and 3) open. More specifically, in FIG. 2, the inner handle 12 is rotated to an up position 40. In the up position 40 the deadbolt 36 and the latchbolt 30 are both extended (bolted and latched) and the door is locked.

In FIG. 3, the inner handle 12 has been rotated from the up position 40 to the intermediate position 42. As the handle moves between these two positions, the deadbolt 36 is retracted (unbolted). When the inner handle 12 fully reaches the intermediate position 42, the deadbolt 36 has been fully retracted into the door.

As the handle continues to move from the intermediate position 42 to the down position 44, the latchbolt 30 is retracted. As can be seen in FIG. 4, with the handle 12 in the fully down position, the latchbolt 30 is fully retracted and the door is free to open.

As the inner handle moves between the up position 40 and the intermediate position 42, the deadbolt moves between the bolted and unbolted positions. Unlike prior art interconnected locks, as in FIG. 1*a*, the inner handle 12 can also be used to extend the deadbolt. Accordingly, a separate thumb turnpiece 13 on the interior of the door is not required to extend the deadbolt. This greatly simplifies the operation of the lock as it is no longer necessary to operate a separate thumb turnpiece to extend the deadbolt.

In addition to improving security, the design of this invention decreases the maximum torque required to operate the lock mechanism. Because the deadbolt and latchbolt retraction occur at different sectors of the inner handle's rotation, at no point is it necessary to simultaneously drive both the deadbolt and the latchbolt.

The torque required to operate the handle as it moves from the up position 40 to the intermediate position 42 depends solely upon the friction and spring pressure required to operate the deadbolt lock mechanism. The torque required to rotate the inner handle from the intermediate position 42 to the down position 44 depends solely upon the design of the latchbolt lock mechanism. Accordingly, unlike the prior art which retracts both the deadbolt and latchbolt simultaneously, the interconnected lock of the present invention does not increase the torque required to operate the lock above that required for a separate deadbolt or latchbolt lock mechanism.

In addition to the security advantage, the simplified deadbolt extension advantage and the reduced torque advantage, the present invention makes it much easier to verify that the door is locked. Those who have poor eyesight, and those who are far away from the door can easily see if the door is properly bolted simply by referring to the position of the inner handle.

Figure 7:
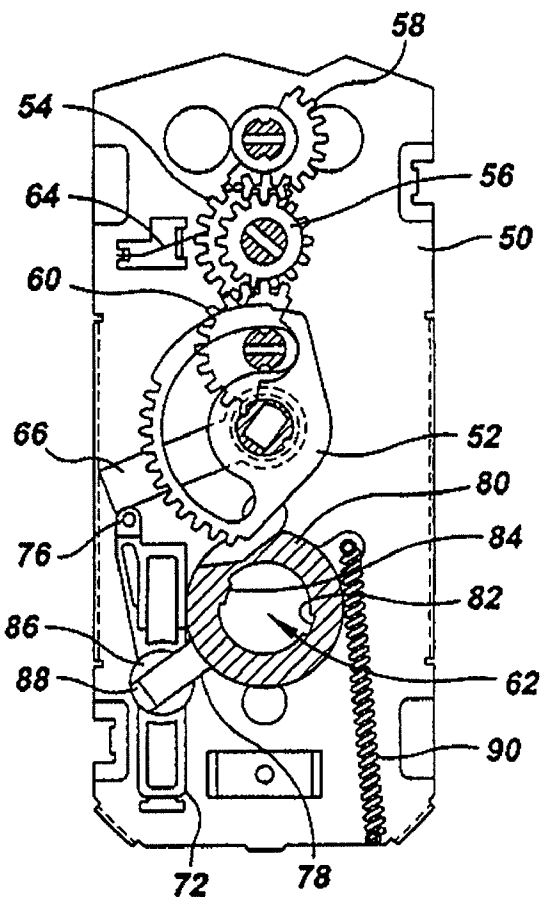
FIGS. 5-7 show the interconnecting mechanism inside the interconnected lock of FIGS. 1-4. The interconnecting mechanism lies underneath a cover or scalp which can be seen in FIG. 1 on the inner side of the door. The gears and other elements seen in FIGS. 5-7 are mounted between two plates, and the front plate has been removed to show the orientation of the various elements. The removed front plate is identical to the back plate illustrated in these drawings.
Figure 6:
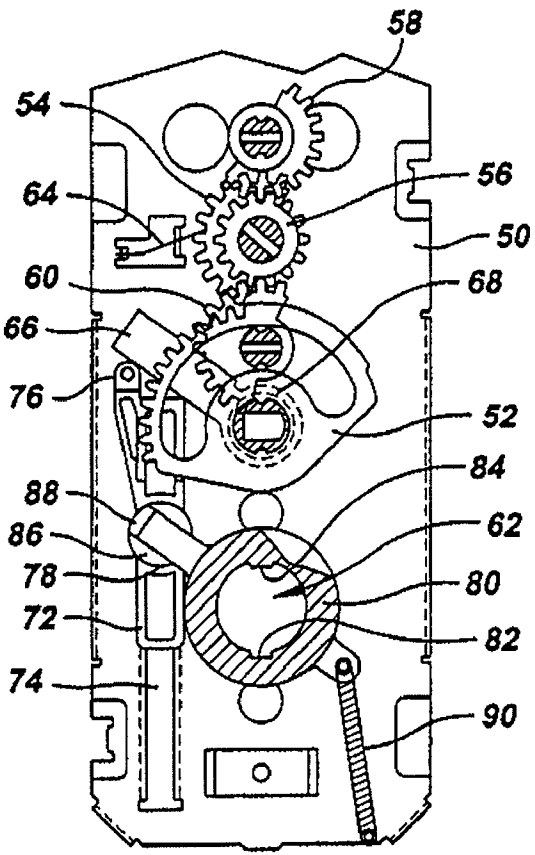
Figure 5:
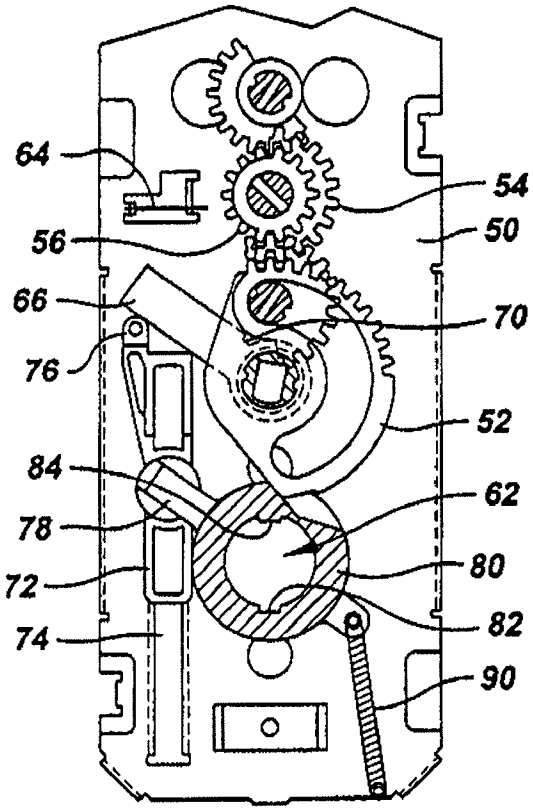

The details of the interconnecting mechanism 10 are shown in FIGS. 5-7, which illustrate the interconnecting mechanism components and their relative positions in the three positions shown in FIGS. 2-4. FIG. 5 corresponds to FIG. 2 with the deadbolt 36 in the bolted position and the latchbolt 30 in the latched position. FIG. 6 corresponds to FIG. 3 with the deadbolt retracted (unbolted) and the latchbolt extended (latched) with the inner handle in the intermediate position. FIG. 7 corresponds to FIG. 4 with both the deadbolt and latchbolt retracted (unbolted and unlatched) and the inner handle 12 in the down position.

The interconnecting mechanism in FIGS. 5-7 includes a series of gears mounted on a backing plate 50. An identical front plate has been removed to show the placement of the internal components. The backing plate and front plate hold the internal components sandwiched between them and act as bearings to hold shafts necessary for the gears illustrated. The entire interconnection assembly is mounted to the inside surface 18 of the door 20 and is covered by a decorative cover or scalp as seen in FIGS. 2-4.

Referring to FIG. 5, the interconnecting mechanism includes a handle gear 52 which is a partial gear having teeth along a first sector of about 90° and a smooth toothless perimeter on the rest of the gear. The handle gear 52 is driven at all times by the inner handle 12 and moves with that handle as can be seen by comparing the position of that gear in FIGS. 5, 6 and 7 with the corresponding position of the handle in FIGS. 2, 3 and 4.

The handle gear 52 drives a deadbolt gear train whenever the geared portion engages that gear train, but does not drive the deadbolt gear train when the smooth sector reaches the point of geared contact with the deadbolt gear train.

The deadbolt gear train is composed of a primary deadbolt gear 54, an intermediate deadbolt gear 56, mounted on the same shaft as the primary deadbolt gear, and a pair of secondary deadbolt gears 58, 60 that lie above and below the primary and intermediate deadbolt gears.

As the inner handle 12 moves from the up position in FIG. 5 to the intermediate position in FIG. 6, the handle gear 52 rotates and drives the primary deadbolt gear 54. The primary deadbolt gear is also a partial gear and stops rotating when the toothless smooth portion of the handle gear 52 approaches the contact point with the primary deadbolt gear 54.

As the inner handle moves from the up position to the intermediate position from FIG. 5 to FIG. 6, the primary deadbolt gear and intermediate deadbolt gear 56 both rotate. The rotation of the intermediate deadbolt gear 56 drives the secondary deadbolt gears 58, 60. The two secondary deadbolt gears are located on shafts that are offset two different distances from the axis of rotation of the outer handle at 62. The offset distances correspond to industry standard offset distances between the first bore for the latchbolt lock mechanism and the second bore for the deadbolt lock mechanism.

This design allows the interactive mechanism to be installed with either of the two standard offsets between the deadbolt and latchbolt and permits the use of standard templates and fixtures. The interconnected lock can be used in preexisting installations with preexisting standard offset bores for the latchbolt and deadbolt.

Accordingly, the outer portion of the deadbolt lock mechanism will be axially aligned with the axis of rotation of secondary deadbolt gear 58 or secondary deadbolt gear 60. The slot in the center of the axis of deadbolt gear 58 or deadbolt gear 60 receives a shaft from the deadbolt lock mechanism. The rotation of the deadbolt gear train as the inner handle moves between the intermediate and up positions will drive the deadbolt between the bolted and unbolted positions. Raising the inner handle extends the deadbolt and lowering the handle retracts it.

The smooth segment portion of the handle gear 52 and the partial gear design of the primary deadbolt gear 54 ensure that rotation of the inner handle between the intermediate position and the down position has no effect on the deadbolt lock mechanism.

Because the primary deadbolt gear 54 disengages from the handle gear 52 as the smooth portion of the handle gear reaches the point of contact, a reengagement spring 64 is provided. As can be seen in FIG. 5, the reengagement spring comprises a spring arm. The spring arm contacts a tab on the primary deadbolt gear 54 just as that gear disengages from the tooth sector of the handle gear 52 and stays in spring loaded contact with the smooth, untoothed sector of the handle gear.

The reengagement spring 64 provides a rotation torque to the primary deadbolt gear to ensure that the first tooth on the partial portion of the primary deadbolt gear 54 properly reengages the first tooth in the toothed sector of the handle gear 52 as the inner handle is rotated from below the intermediate position past the intermediate position toward the up position.

During the operation of the deadbolt lock mechanism described above, the latchbolt is unaffected. To operate the latchbolt lock mechanism a first latchbolt lever 66 is mounted to freely rotate on the same axis as the handle gear 52. The handle gear 52 drives the first latchbolt lever 66 with a lost motion interaction such that rotating the handle gear 52 from the position in FIG. 5 (inner handle up) to the position in FIG. 6 (intermediate position) has no effect on the first latchbolt lever 66. As can be seen by comparing FIGS. 5 and 6, the handle gear 52 has rotated, but the first latchbolt lever 66 has not moved.

However, as the handle gear reaches the position in FIG. 6, a protruding portion of the hub 68 of the handle gear 52 contacts the first latchbolt lever 66 at the point marked with reference number 70. At this point the first latchbolt lever 66 begins to rotate with the handle gear. The first latchbolt lever 66 rotates from the position in FIG. 6 (latchbolt extended) to the position seen in FIG. 7 (latchbolt retracted). The lost motion interval from FIG. 5 to FIG. 6 ensures that the handle gear does not drive the latchbolt when the inner handle is moving from the up position to the intermediate position.

As the inner handle moves past the intermediate position to the down position, and the first latchbolt lever moves from the latchbolt extended position in FIG. 6 to the latchbolt retracted position in FIG. 7, the first latchbolt lever drives a latchbolt slide 72. The latchbolt slide moves vertically in slot 74. The latchbolt slide 72 is provided with a roller 76 to reduce friction between the latchbolt lever 66 and the slide 72.

The latchbolt slide 72 drives a second latchbolt lever 78, which rotates a latchbolt hub 80. The latchbolt hub 80 includes a notch 82 and a tab 84 that engage and drive the latchbolt lock mechanism to retract the latchbolt as the inner handle moves from the intermediate position to the down position.

The latchbolt slide 72 drives the second latchbolt lever 78 with a rotating bearing 86 having a slide channel 88 formed therein. As the slide moves down, the distance between the axis of rotation 62 of the outer handle and the bearing 86 changes. The second latchbolt lever slides axially in the slide channel 88 of the rotating bearing 86 to accommodate this changing distance. This design provides a solid feel to the interconnected lock while simultaneously reducing friction.

The latchbolt hub 80 is biased to bring the latchbolt slide 72 back to its initial position with spring 90, which also biases the inner handle back toward the intermediate position.

Figure 8:
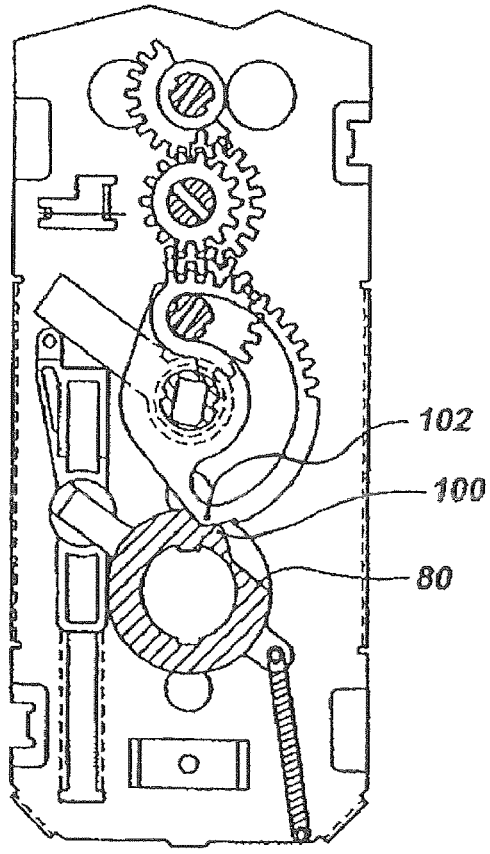
FIG. 8 shows a second embodiment of the interconnecting mechanism where a gear driven by the inner handle interferes with a hub connected to the inner spindle of the latchbolt lock mechanism. For passage function latchbolt lock mechanisms, where the inner spindle is connected to the outer spindle and outer handle, this design prevents the outer handle from turning when the inner handle is in the orientation shown.

FIG. 8 is substantially identical to FIG. 5 except that it shows a modified version of the latchbolt hub 80. This modification is used with latchbolt lock mechanisms provided with a passage function in which the inner and outer spindles of the latchbolt lock are directly connected together.

In the alternative design shown in FIG. 8, the latchbolt hub 80 is provided with a protruding stop 100 that contacts the handle gear at 102. When the inner handle is in the up position, as illustrated in FIG. 8, the portion 102 of the handle gear prevents the protrusion 100 on the latchbolt hub 80 from rotating. This prevents the inner spindle of the latchbolt lock mechanism from turning. When the latchbolt lock mechanism used has the inner and outer spindles directly linked (passage function) this locks the outer handle against motion when the inner handle is up.

As can be seen by comparing FIGS. 6 and 7, as soon as the inner handle is rotated toward the intermediate or the down position, the handle gear disengages from the latchbolt hub 80 and operation is identical to the operation described above.

It will be seen from the description above that the objectives of this invention have been achieved. The deadbolt lock mechanism and latchbolt lock mechanism operate independently, yet they interact as desired for an interconnected lock. Security has been improved, handle torque has been reduced as compared to prior art interconnect locks, and deadbolt extension has been simplified, allowing the removal of the thumb turnpiece of prior art locks. Finally, the status of the lock can easily be determined by visual inspection of the position of the inner handle.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An interconnecting mechanism for driving a latchbolt of a latchbolt lock mechanism in a first bore of a door and a deadbolt of a deadbolt lock mechanism in a second bore of the door, the interconnecting mechanism comprising:

a handle gear rotated by an inner handle, the inner handle being movable between an up position, an intermediate position and a down position;

at least one deadbolt gear connected to drive the deadbolt between bolted and unbolted positions, the at least one deadbolt gear being driven by the handle gear as the inner handle moves between the up position and the intermediate position, and the at least one deadbolt gear not being driven by the handle gear as the inner handle moves between the intermediate position and the down position;

a latchbolt hub connected to drive the latchbolt between latched and unlatched positions, the latchbolt hub being driven by the handle gear with lost motion such that the latchbolt hub is not driven by the handle gear as the inner handle moves between the up position and the intermediate position, and the latchbolt hub is driven by the handle gear as the inner handle moves between the intermediate position to the down position;

wherein the handle gear drives a first latchbolt lever, the first latchbolt lever drives a latchbolt slide vertically and the latchbolt slide drives a second latchbolt lever connected to the latchbolt hub.

2. The interconnecting mechanism according to claim 1 wherein the latchbolt slide includes a roller to reduce friction between the first latchbolt lever and the latchbolt slide.

3. The interconnecting mechanism according to claim 1 wherein the latchbolt slide engages the second latchbolt lever with a rotating bearing having a slide channel formed therein, the rotating bearing rotating in the latchbolt slide and the second latchbolt lever sliding in the slide channel of the rotating bearing.

4. An interconnecting mechanism for driving a latchbolt of a latchbolt lock mechanism in a first bore of a door and a deadbolt of a deadbolt lock mechanism in a second bore of the door, the interconnecting mechanism comprising:

a handle gear rotated by an inner handle, the inner handle being movable between an up position, an intermediate position and a down position;

at least one deadbolt gear connected to drive the deadbolt between bolted and unbolted positions, the at least one deadbolt gear being driven by the handle gear as the inner handle moves between the up position and the intermediate position, and the at least one deadbolt gear not being driven by the handle gear as the inner handle moves between the intermediate position and the down position;

a latchbolt hub connected to drive the latchbolt between latched and unlatched positions, the latchbolt hub being driven by the handle gear with lost motion such that the latchbolt hub is not driven by the handle gear as the inner handle moves between the up position and the intermediate position, and the latchbolt hub is driven by the handle gear as the inner handle moves between the intermediate position to the down position;

the interconnecting mechanism further including a reengagement spring, the reengagement spring applying a force to the at least one deadbolt gear to engage the at least one deadbolt gear with the handle gear as the inner handle is rotated from below the intermediate position past the intermediate position toward the up position.

5. An interconnecting mechanism for driving a latchbolt of a latchbolt lock mechanism in a first bore of a door and a deadbolt of a deadbolt lock mechanism in a second bore of the door, the interconnecting mechanism comprising:

a handle gear rotated by an inner handle, the inner handle being movable between an up position, an intermediate position and a down position;

at least one deadbolt gear connected to drive the deadbolt between bolted and unbolted positions, the at least one deadbolt gear being driven by the handle gear as the inner handle moves between the up position and the intermediate position, and the at least one deadbolt gear not being driven by the handle gear as the inner handle moves between the intermediate position and the down position;

a latchbolt hub connected to drive the latchbolt between latched and unlatched positions, the latchbolt hub being driven by the handle gear with lost motion such that the latchbolt hub is not driven by the handle gear as the inner handle moves between the up position and the intermediate position, and the latchbolt hub is driven by the handle gear as the inner handle moves between the intermediate position to the down position;

wherein the at least one deadbolt gear drives two secondary deadbolt gears forming two alternative deadbolt drivers, the two deadbolt drivers being offset from an axis of the first bore by distances that correspond to two industry standard bore offset distances for installing separate latchbolt locks and deadbolt locks.

6. The interconnecting mechanism according to claim 5 wherein the at least one deadbolt gear drives an intermediate deadbolt gear, the intermediate deadbolt gear driving the two secondary deadbolt gears.

7. The interconnecting mechanism according to claim 5 wherein the interconnecting mechanism disconnects the latchbolt lock mechanism from the deadbolt lock mechanism when the inner handle is moved to the up position such that manipulation of the latchbolt lock mechanism to move the latchbolt to the unlatched position does not move the deadbolt to the unbolted position.

8. The interconnecting mechanism according to claim 5 wherein the handle gear comprises a partial gear.

9. An interconnecting mechanism for driving a latchbolt lock mechanism having a latchbolt in a first bore of a door and a deadbolt lock mechanism having a deadbolt in a second bore of the door, the interconnecting mechanism comprising:

a driving piece rotated by an inner handle, the inner handle being movable between an up position, an intermediate position and a down position;

at least one deadbolt member connected to drive the deadbolt lock mechanism between bolted and unbolted positions, the at least one deadbolt member being driven by the driving piece as the inner handle moves between the intermediate position and the up position to place the deadbolt in the bolted position when the inner handle is moved to the up position and to place the deadbolt in the unbolted position when the inner handle is moved to the intermediate position, and the at least one deadbolt member not being driven by the driving piece as the inner handle moves between the intermediate position and the down position;

a latchbolt member connected to drive the latchbolt lock mechanism between latched and unlatched positions, the latchbolt member being driven by the driving piece as the inner handle moves between the intermediate position and the down position to place the latchbolt in the unlatched position when the inner handle is moved to the down position, and the latchbolt member not being driven by the driving piece as the inner handle moves between the intermediate position and the up position;

wherein the latchbolt is driven by an outer handle and the inner handle and outside handle rotate on different axes of rotation, the axis of rotation of the outer handle being through the first bore and the axis of rotation of the inner handle being between the first and second bores through the door.

10. An interconnecting mechanism for driving a latchbolt lock mechanism having a latchbolt in a first bore of a door and a deadbolt lock mechanism having a deadbolt in a second bore of the door, the interconnecting mechanism comprising:

a driving piece rotated by an inner handle, the inner handle being movable between an up position, an intermediate position and a down position;

at least one deadbolt member connected to drive the deadbolt lock mechanism between bolted and unbolted positions, the at least one deadbolt member being driven by the driving piece as the inner handle moves between the intermediate position and the up position to place the deadbolt in the bolted position when the inner handle is moved to the up position and to place the deadbolt in the unbolted position when the inner handle is moved to the intermediate position, and the at least one deadbolt member not being driven by the driving piece as the inner handle moves between the intermediate position and the down position;

a latchbolt member connected to drive the latch bolt between latched and unlatched positions, the latchbolt member being driven by the driving piece as the inner handle moves between the intermediate position and the down position to place the latchbolt in the unlatched position when the inner handle is moved to the down position, and the latchbolt member not being driven by the driving piece as the inner handle moves between the intermediate position and the up position;

wherein the interconnecting mechanism includes two deadbolt drivers, the two deadbolt drivers being driven by the deadbolt member and the two deadbolt drivers being offset from an axis of rotation of the outside handle by distances that correspond to two industry standard bore offset distances for installing separate latchbolt locks and deadbolt locks.

11. An interconnecting mechanism for driving a latchbolt lock mechanism having a latchbolt in a first bore of a door and a deadbolt lock mechanism having a deadbolt in a second bore of the door, the interconnecting mechanism comprising:

a driving piece rotated by an inner handle, the inner handle being movable between an up position, an intermediate position and a down position;

at least one deadbolt member connected to drive the deadbolt between bolted and unbolted positions, the at least one deadbolt member being driven by the driving piece as the inner handle moves between the intermediate position and the up position to place the deadbolt in the bolted position when the inner handle is moved to the up position and to place the deadbolt in the unbolted position when the inner handle is moved to the intermediate position, and the at least one deadbolt member not being driven by the driving piece as the inner handle moves between the intermediate position and the down position;

a latchbolt member connected to drive the latchbolt between latched and unlatched positions, the latchbolt member being driven by the driving piece as the inner handle moves between the intermediate position and the down position to place the latchbolt in the unlatched position when the inner handle is moved to the down position, and the latchbolt member not being driven by the driving piece as the inner handle moves between the intermediate position and the up position;

wherein the driving piece includes a handle gear, the at least one deadbolt member includes at least one deadbolt gear and the latchbolt member includes a latchbolt hub;

wherein the handle gear comprises a partial gear engaged with and driving the at least one deadbolt gear as the inner handle moves from the up position to the intermediate position to drive the deadbolt from the bolted to the unbolted position, the handle gear not driving the at least one deadbolt gear as the inner handle moves from the intermediate position to the down position; and the interconnecting mechanism further including a reengagement spring, the reengagement spring applying a force to the at least one deadbolt gear to engage the at least one deadbolt gear with the handle gear as the inner handle is rotated from below the intermediate position past the intermediate position toward the up position.

12. The interconnecting mechanism according to claim 11 wherein the at least one deadbolt gear drives two secondary deadbolt gears forming two alternative deadbolt drivers, the two deadbolt drivers being offset from an axis of rotation of the outside handle by distances that correspond to two industry standard bore offset distances for installing separate latchbolt locks and deadbolt locks.

13. The interconnecting mechanism according to claim 12 wherein the at least one deadbolt gear drives an intermediate deadbolt gear, the intermediate deadbolt gear driving the two secondary deadbolt gears.

14. An interconnecting mechanism for driving a latchbolt lock mechanism havin a latchbolt in a first bore of a door and a deadbolt lock mechanism having a deadbolt in a second bore of the door, the interconnecting mechanism comprising:

a driving piece rotated by an inner handle, the inner handle being movable between an up position, an intermediate position and a down position;

at least one deadbolt member connected to drive the deadbolt lock mechanism between bolted and unbolted positions, the at least one deadbolt member being driven by the driving piece as the inner handle moves between the intermediate position and the up position to place the deadbolt in the bolted position when the inner handle is moved to the up position and to place the deadbolt in the unbolted position when the inner handle is moved to the intermediate position, and the at least one deadbolt member not being driven by the driving piece as the inner handle moves between the intermediate position and the down position;

a latchbolt member connected to drive the latch bolt between latched and unlatched positions, the latchbolt member being driven by the driving piece as the inner handle moves between the intermediate position and the down position to place the latchbolt in the unlatched position when the inner handle is moved to the down position, and the latchbolt member not being driven by the driving piece as the inner handle moves between the intermediate position and the up position;

wherein the driving piece includes a first latchbolt lever and the inner handle drives the first latchbolt lever with lost motion from a latchbolt extended position to a latchbolt retracted position, the inner handle not driving the first latchbolt lever as the inner handle moves from the up position to the intermediate position during a lost motion interval, and the inner handle driving the first latchbolt lever from the latchbolt extended position to the latchbolt retracted position to retract the latchbolt as the inner handle moves from the intermediate position to the down position.

15. The interconnecting mechanism according to claim 14 wherein the first latchbolt lever drives a latchbolt slide vertically, the latchbolt slide driving a second latchbolt lever connected to the latchbolt member, the latchbolt member being connected to drive the latchbolt lock mechanism to retract the latchbolt.

16. The interconnecting mechanism according to claim 15 wherein the latchbolt slide includes a roller to reduce friction between the first latchbolt lever and the latchbolt slide.

17. The interconnecting mechanism according to claim 16 wherein the latchbolt slide engages the second latchbolt lever with a rotating bearing having a slide channel formed therein, the rotating bearing rotating in the latchbolt slide and the second latchbolt lever sliding in the slide channel of the rotating bearing.

* * * * *

UNITED STATES PATENT AND TRADEMARK OFFICE

CERTIFICATE OF CORRECTION

PATENT NO. : 7,856,856 B2
APPLICATION NO. : 12/034144
DATED : December 28, 2010
INVENTOR(S) : Shvartz It is certified that error appears in the above-identified patent and that said Letters Patent is hereby corrected as shown below:

At column 11, line 40, Claim 9, delete “lock mechanism”;

At column 11, lines 51-52, Claim 9, delete “lock mechanism”;

At column 13, line 25, Claim 14, delete “havin” and substitute therefor -- having --.

Signed and Sealed this
Twenty-fourth Day of May, 2011

David J. Kappos
*Director of the United States Patent and Trademark Office*